US007874092B2

(12) United States Patent
Lee

(10) Patent No.: US 7,874,092 B2
(45) Date of Patent: Jan. 25, 2011

(54) HEAD FOR A GUN SUPPORT

(75) Inventor: Lihwa Lee, Guangdong (CN)

(73) Assignee: Foshan Nanhai Chevan Optical Electronics Co., Ltd., Carp Industrial Area, Dawo Danzao Town, Nanhai Foshan, Guangdong (CN)

( * ) Notice: Subject to any disclaimer, the term of this patent is extended or adjusted under 35 U.S.C. 154(b) by 206 days.

(21) Appl. No.: 12/353,916

(22) Filed: Jan. 14, 2009

(65) Prior Publication Data

US 2010/0154277 A1 Jun. 24, 2010

(30) Foreign Application Priority Data

Dec. 24, 2008 (CN) ..... 2008 2 0182826 U

(51) Int. Cl.
*F41C 27/00* (2006.01)

(52) U.S. Cl. ..... 42/94

(58) Field of Classification Search ..... 42/94
See application file for complete search history.

(56) References Cited

U.S. PATENT DOCUMENTS

| | | | | |
|---|---|---|---|---|
| 3,445,082 | A * | 5/1969 | Frazer et al. | 248/183.3 |
| 2002/0121163 | A1 * | 9/2002 | Cheng | 81/133 |
| 2002/0133998 | A1 * | 9/2002 | Murray et al. | 42/70.07 |
| 2006/0025810 | A1 * | 2/2006 | Shelton | 606/205 |
| 2007/0198038 | A1 * | 8/2007 | Cohen et al. | 606/150 |
| 2008/0294206 | A1 * | 11/2008 | Choi et al. | 606/86 A |

* cited by examiner

*Primary Examiner*—Troy Chambers
(74) *Attorney, Agent, or Firm*—Global IP Services; Tianhua Gu

(57) ABSTRACT

A Head for a gun support apparatus is provided, which includes a body, a left arm assembly, a right arm assembly, and a blocking member. The left arm assembly is pivotally coupled to the body, and the right arm assembly is pivotally coupled to the body and is engaged to the left arm assembly so that they can be revolved simultaneously. The blocking member is engaged to both the left arm assembly and the right arm assembly to form a ratchet mechanism.

13 Claims, 9 Drawing Sheets

HEAD FOR A GUN SUPPORT

CROSS REFERENCE TO RELATED PATENT APPLICATION

This application claims the priority of the Chinese patent application No. 200820182826.4 filed on Dec. 24, 2008, which application is incorporated herein by reference.

FIELD OF THE INVENTION

The present invention relates to heads for gun supports, and more particularly to heads for gun support with adjustable arms.

BACKGROUND OF THE INVENTION

Many existing gun support apparatus normally have a V-shaped head with a fixed open angle. Therefore, when mounting guns of various sizes on the gun support apparatus described, the gun barrel may rest at different heights on the arms of the head, which will result in an unsteady gripping since the arms of the head are not firmly and sufficiently contacted with the barrel of the gun. Some other gum mounts have an adjustable head, for these heads, the open angle of the arms is modified by adjusting the open angle of the foot portion where the head seat which makes the operation complex and time taking. Thus it would be desirable to find a gun support apparatus that allows the open angle of the head to be adjusted easily.

Also, many existing gun support apparatus normally have a structure that the head and the feet are fixed in a same plane which makes it impossible to move pivotally and consequently using gun support apparatus of this type can not shoot moving targets. Thus it would also be desirable to find a gun support apparatus that allow pivotal move of the head to facilitate shooting moving targets.

SUMMARY OF THE INVENTION

The problems and needs outlined above are addressed by various aspects of the present invention. In accordance with one aspect of the present invention, a Head for a gun support apparatus is provided, which includes a body, a left arm assembly, a right arm assembly, and a blocking member. The left arm assembly is pivotally coupled to the body, and the right arm assembly is pivotally coupled to the body and is engaged to the left arm assembly so that they can be revolved simultaneously. The blocking member is engaged to both the left arm assembly and the right arm assembly to form a ratchet mechanism.

Preferably, each of the left and/or the right arm assembly comprises an arm and a ratchet wheel fixed to the arm.

Preferably, the arm of the left and the right arm assembly are provided with straight teeth by means of which the left and the right arms are engaged.

Preferably, the ratchet wheels of the left and the right arm assembly comprises a gear portion having at least partially thereon a plurality of ratchet teeth.

Preferably, the blocking member comprises a block assembly which is engaged to the ratchet teeth of the left and right ratchet wheels and is fixed to a button.

Preferably, the block assembly comprising a block and a compression spring attached to a bottom end of the block.

Preferably, a button is fixed to the block through a waist shaped hole on the body, which detaches the block from the ratchet teeth by downward sliding.

Preferably, the block is firmly engaged with the ratchet teeth of the ratchet wheel when the arms are revolved to a predetermined position.

Preferably, the head further comprises a base on which the body can be pivotally mounted.

Preferably, the base is provided with a central straight hole, the body is provided with a central frustum hole, a bolt having an unthreaded frustum section is arranged to pass through both the central holes and fixed to an anti-backlash nut by a washer wherein the unthreaded frustum section engage in the frustum hole on the bottom with a clearance.

Preferably, the clearance can be adjusted by the anti-backlash nut.

Preferably, the central straight hole is provided with internal threads for engaging to a foot of a gun support apparatus.

Preferably, the arms can be revolved to positions having an included angle of 80 degrees, 120 degrees or 160 degrees.

The head for a gun support apparatus according to the present invention is advantageous in that the ratchet mechanism formed by the blocking member, the left and the right arm assembly only allows the arms to revolve together and will not revolve apart unless the blocking member is pushed downwardly. Therefore, insufficient support to the gun barrel is avoided. Also by means of a torsion spring, the arms will be subject to a restoring force that tends to revolve the arms together, therefore, the gun barrel will be provided with an additional clamping force when it seats on the arms.

According to another aspect of the invention, a gun support having at least the head as describe above is provided.

DETAILED DESCRIPTION OF THE INVENTION

Figure 1:
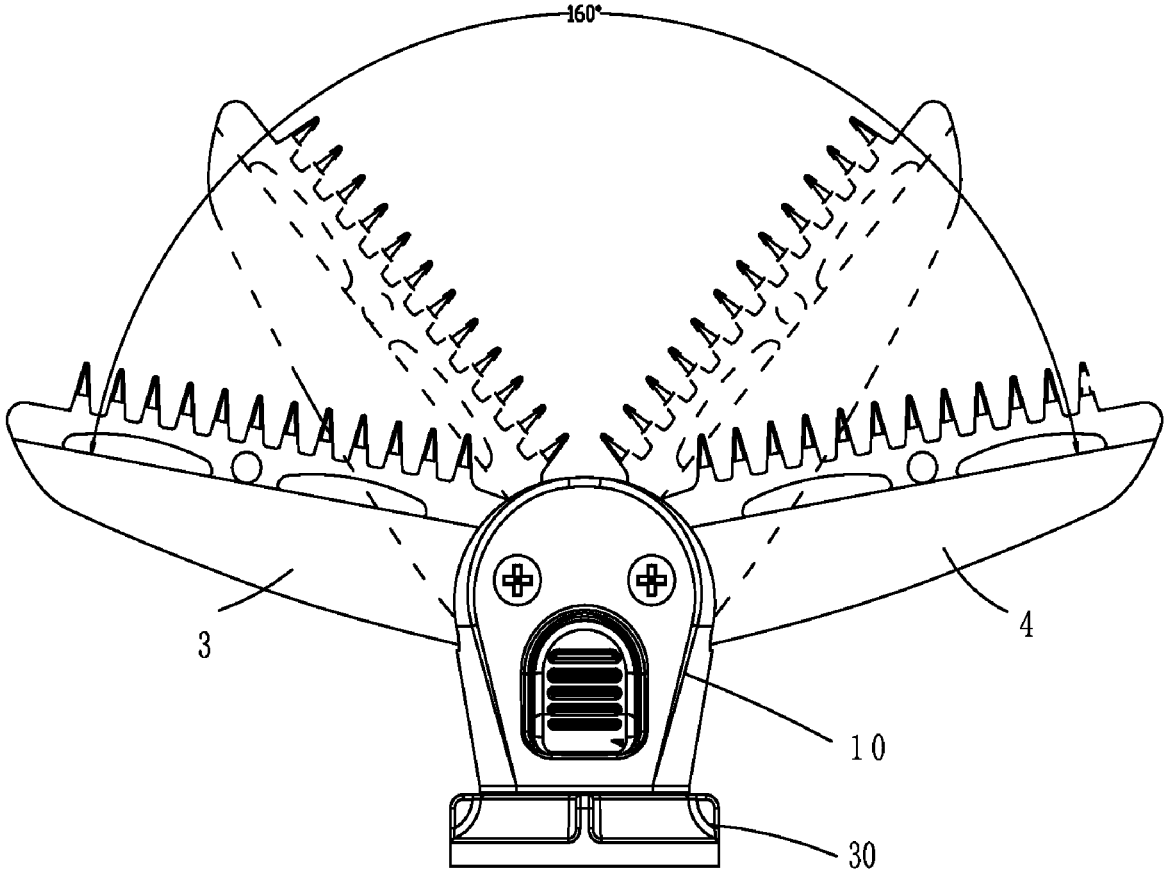
FIG. 1 is a front view of a head according to one embodiment of the invention.
Figure 2:
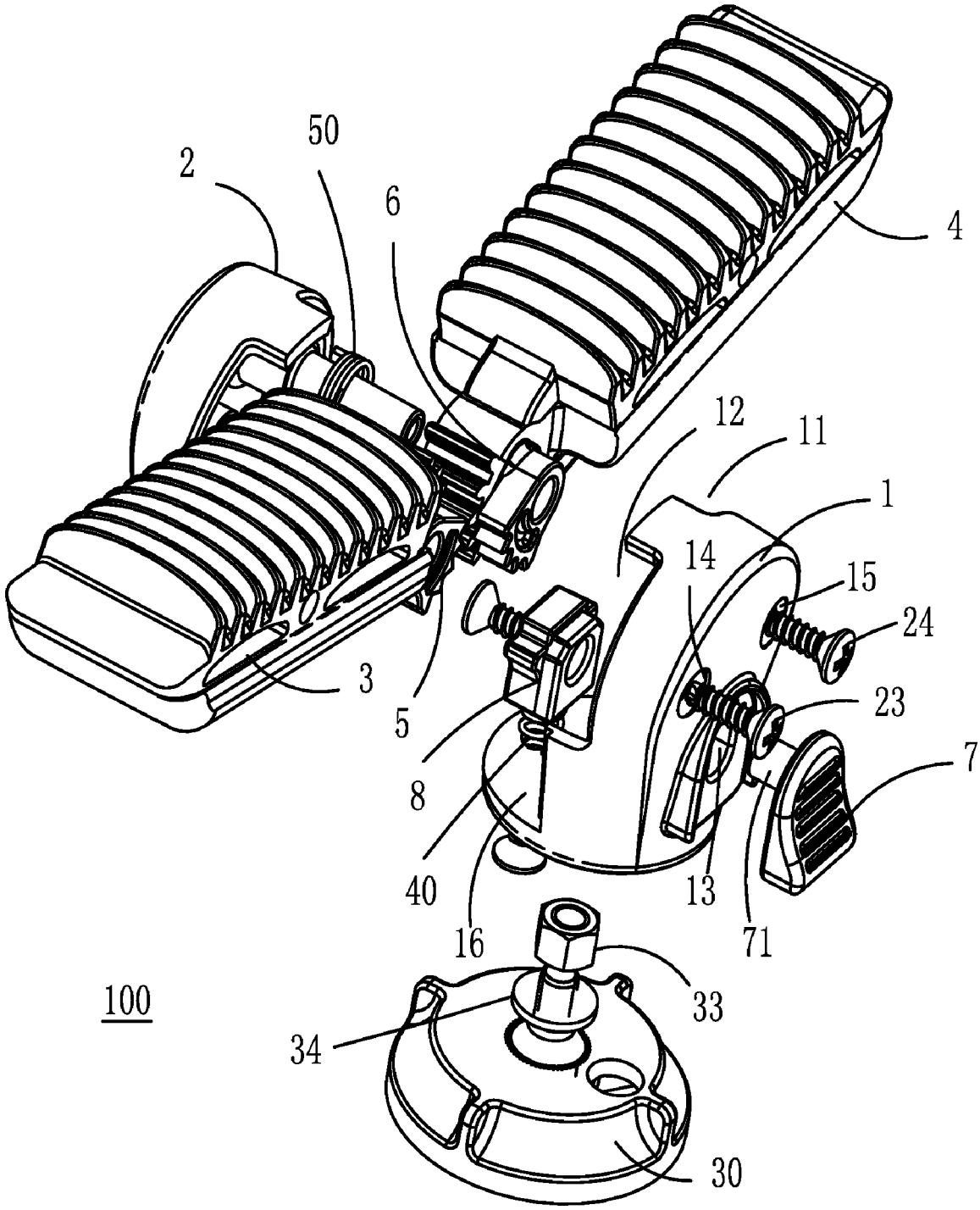
FIG. 2 is a exploded perspective view of a head according to one embodiment of the invention.

FIGS. 1 and 2 shows a Head for a gun support apparatus according to one embodiment of the invention. In such embodiment, the head 100 comprises a front cover 1 and a rear cover 2 which is fixed to the front cover to form a body 10. The body 10 defines a cavity 20, and two openings 11, 12 which are formed on the body and connected to the cavity 20, through which a left arm 3, and a right arm 4 are stretched out respectively.

The rear cover 2 is provided with two horizontally columns 21, 22 arranged for pivotally connected to a left ratchet wheel 5 and a right ratchet wheel 6 respectively. The columns 21, 22 are provided with internal threads by means of which two screws 23, 24 passing through two holes 14, 15 provide on the front cover 1 can fix the front cover 1 and the rear cover together.

Both of the left arm 3 and right arm 4 are provided on one of their ends 27, 28 several straight teeth 271, 281, so that the ends 27, 28 are engaged by these straight teeth. By means of the engagement of the straight teeth, pivotal movement of one of the left or the right arm will result in opposite pivotal movement of the other. For example, if the left arm 3 is applied thereon a torque which causes the left arm to revolve clockwise, the right arm will revolve counter-clockwise result from the engagement of the straight teeth. Preferably, as shown in 9, 11, a torsion spring 50 is provided on one of the columns, with one of its feet fixed to one of the arms 3, 4 and the other fixed to one of the covers 1, 2, so that the left and the right arm the arms subject to a restoring torque whenever they leave the widest opening position.

Figure 3:
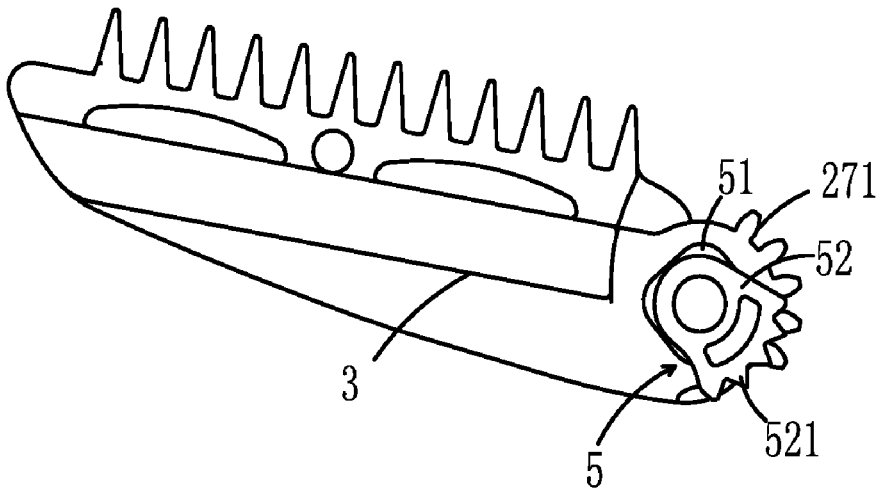
FIG. 3 is a front view of an assembly comprising of a left arm and a left ratchet wheel according to one embodiment of the invention.
Figure 4:
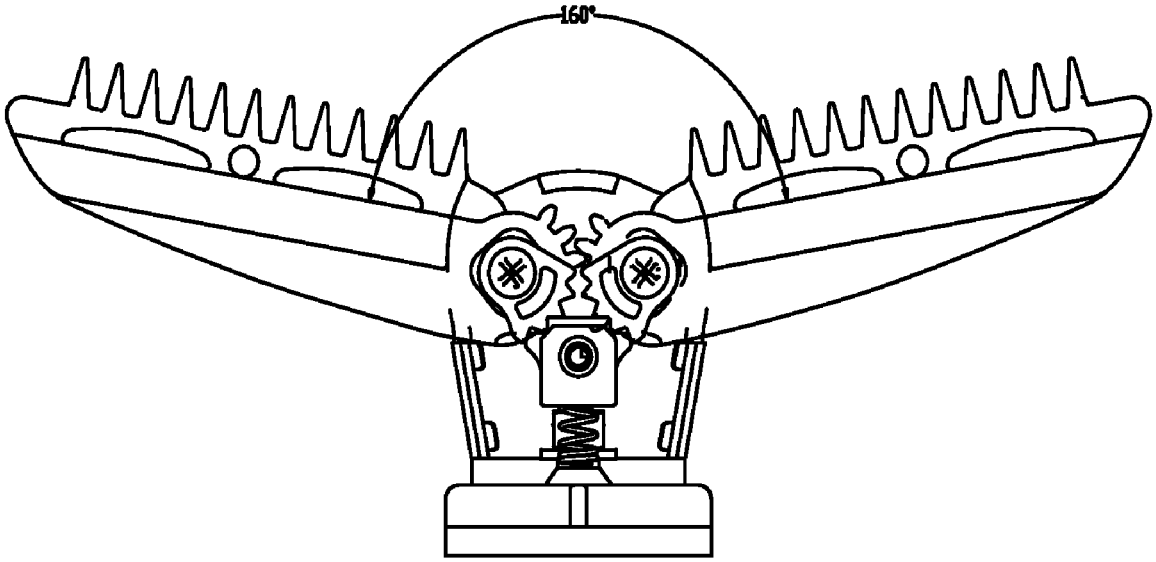
FIG. 4 is a front view of a head according to one embodiment of the invention at its widest opening position.
Figure 5:
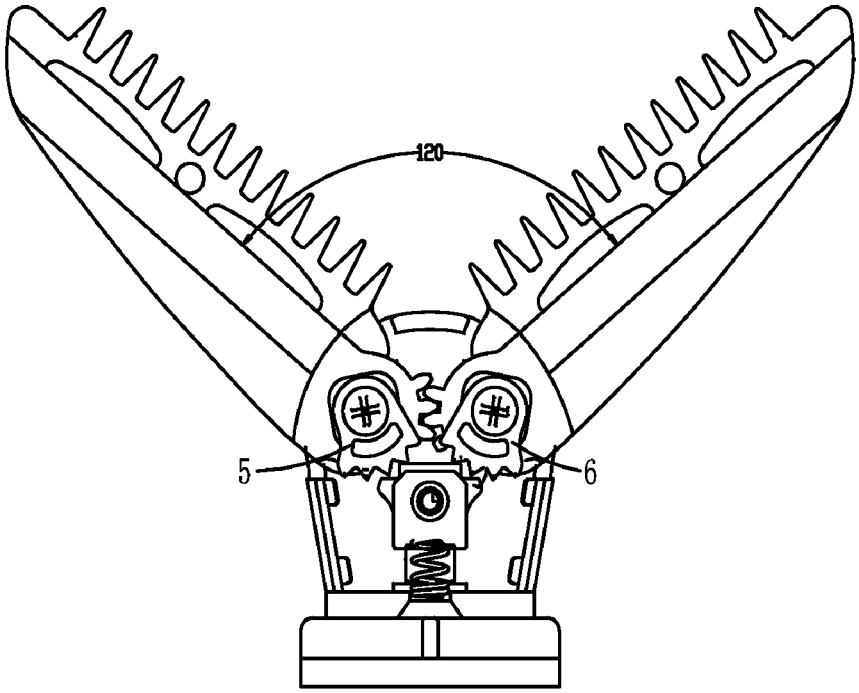
FIG. 5 is a front view of a head according to one embodiment of the invention at one of its intermediate opening position.
Figure 6:
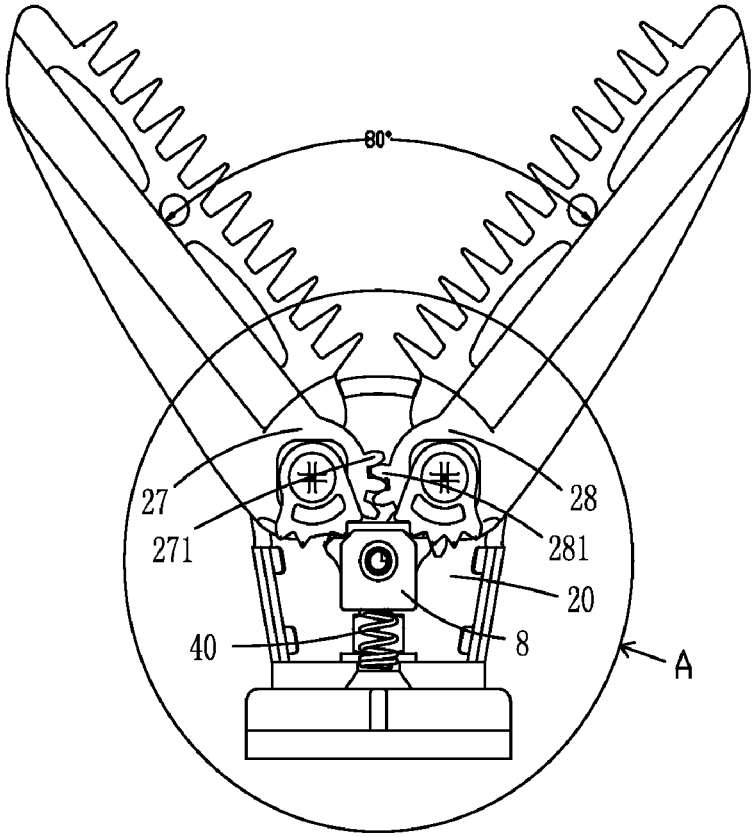
FIG. 6 is a front view of a head according to one embodiment of the invention at another intermediate opening position.

The left arm 3 and the right arm 4 are also fixed respectively thereon the left ratchet wheel 5 and the right ratchet wheel 6 to form a left arm assembly and a right arm assembly. The structure of the left ratchet wheel and the structure of right ratchet wheel are identical. Take the left ratchet wheel 5 as an instance, with reference to FIGS. 2 and 3, the left ratchet wheel 5 is provided with a base portion 51 arranged for entirely or partially fixed into the left arm, and a gear portion 52 fixed onto the base portion 51, having at least partially thereon a plurality of ratchet teeth 521.

The base portion 51 may have a profile of rectangular, triangular or other shape which will not cause circumferential movement when fixed into a seat 31 formed on the left arm 3 of the same shape.

Figure 7:
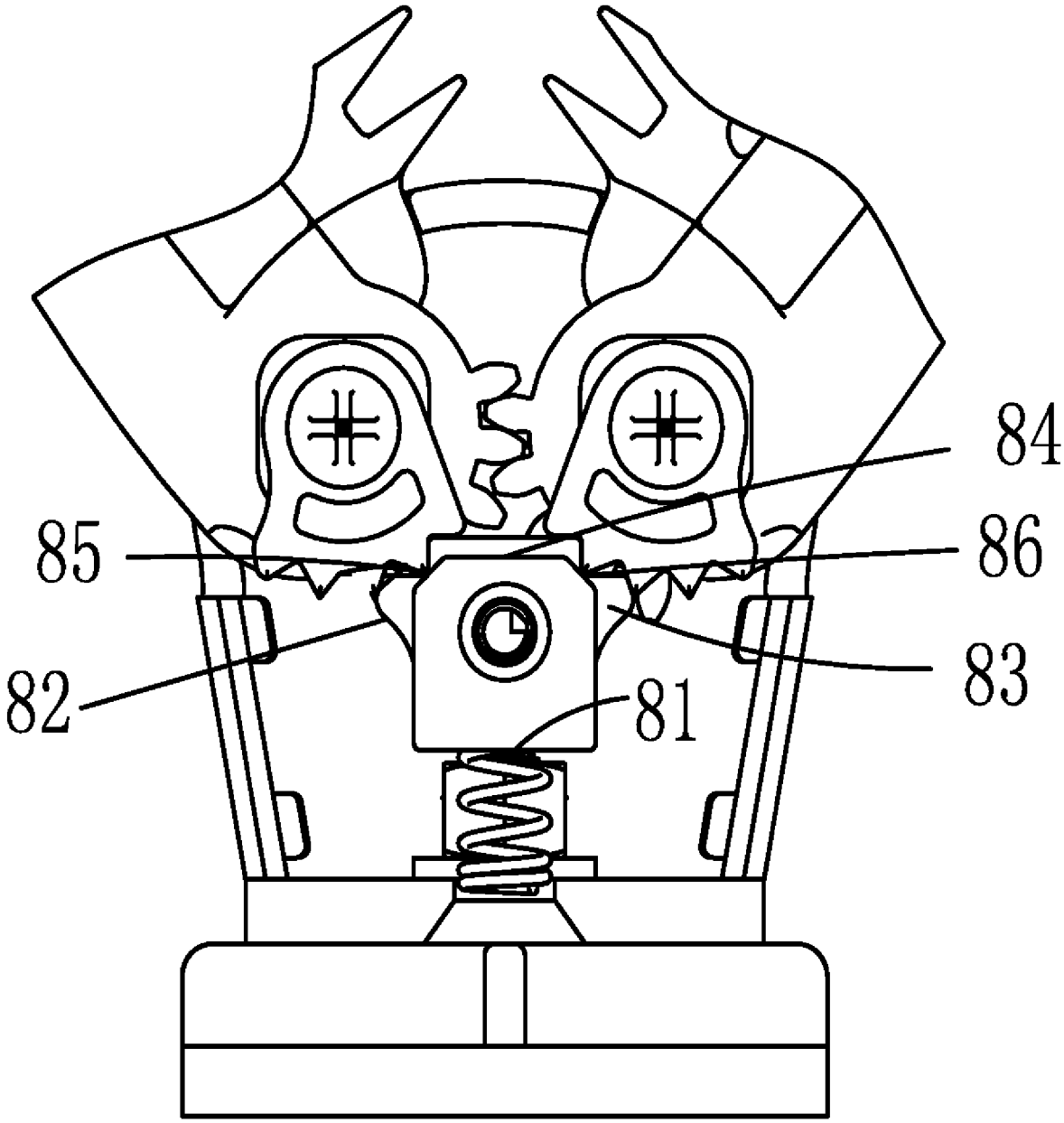
FIG. 7 is an enlarged front view of area A in FIG. 6.
Figure 8:
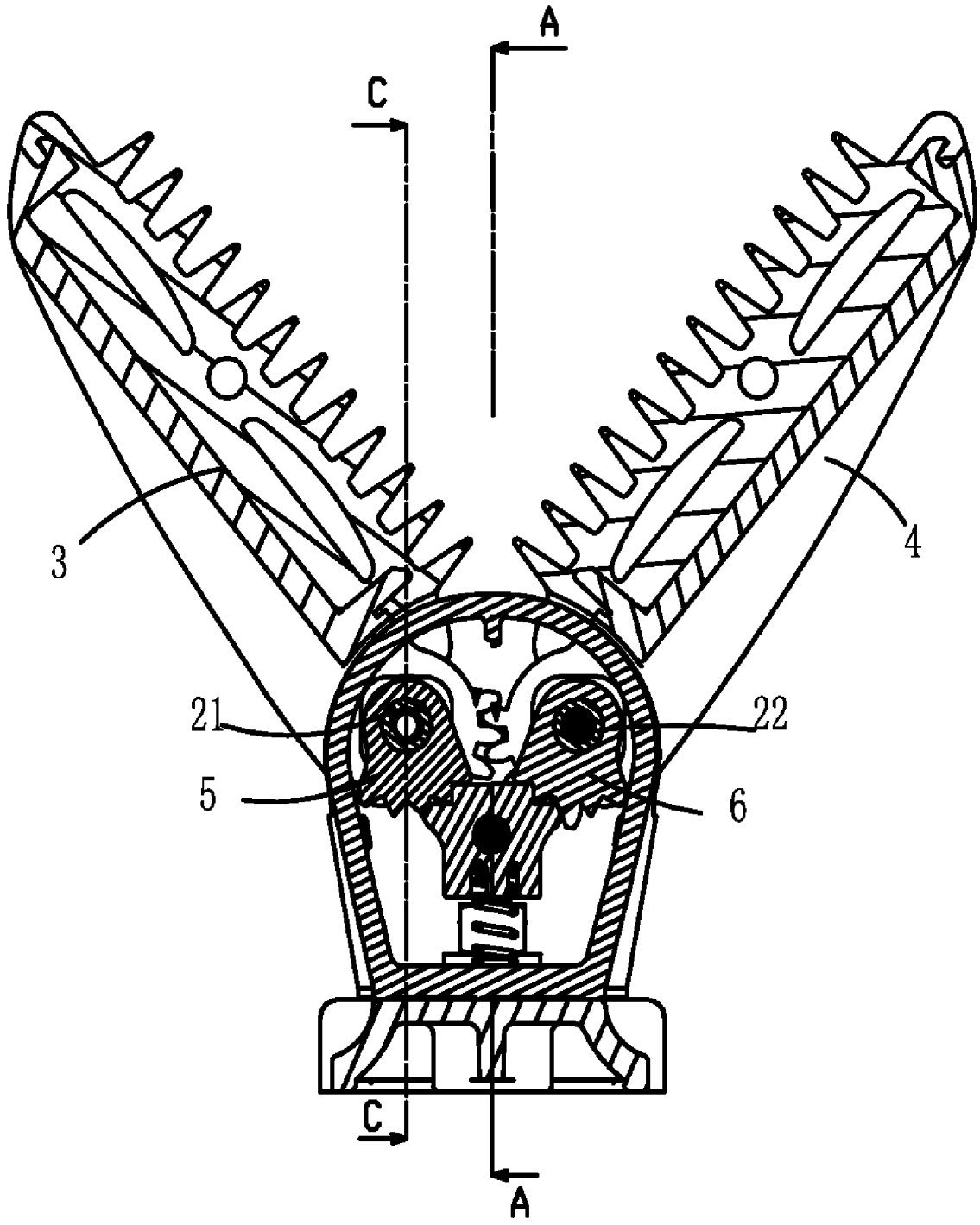
FIG. 8 is a perspective sectional view of a head according to one embodiment of the invention.
Figure 10:
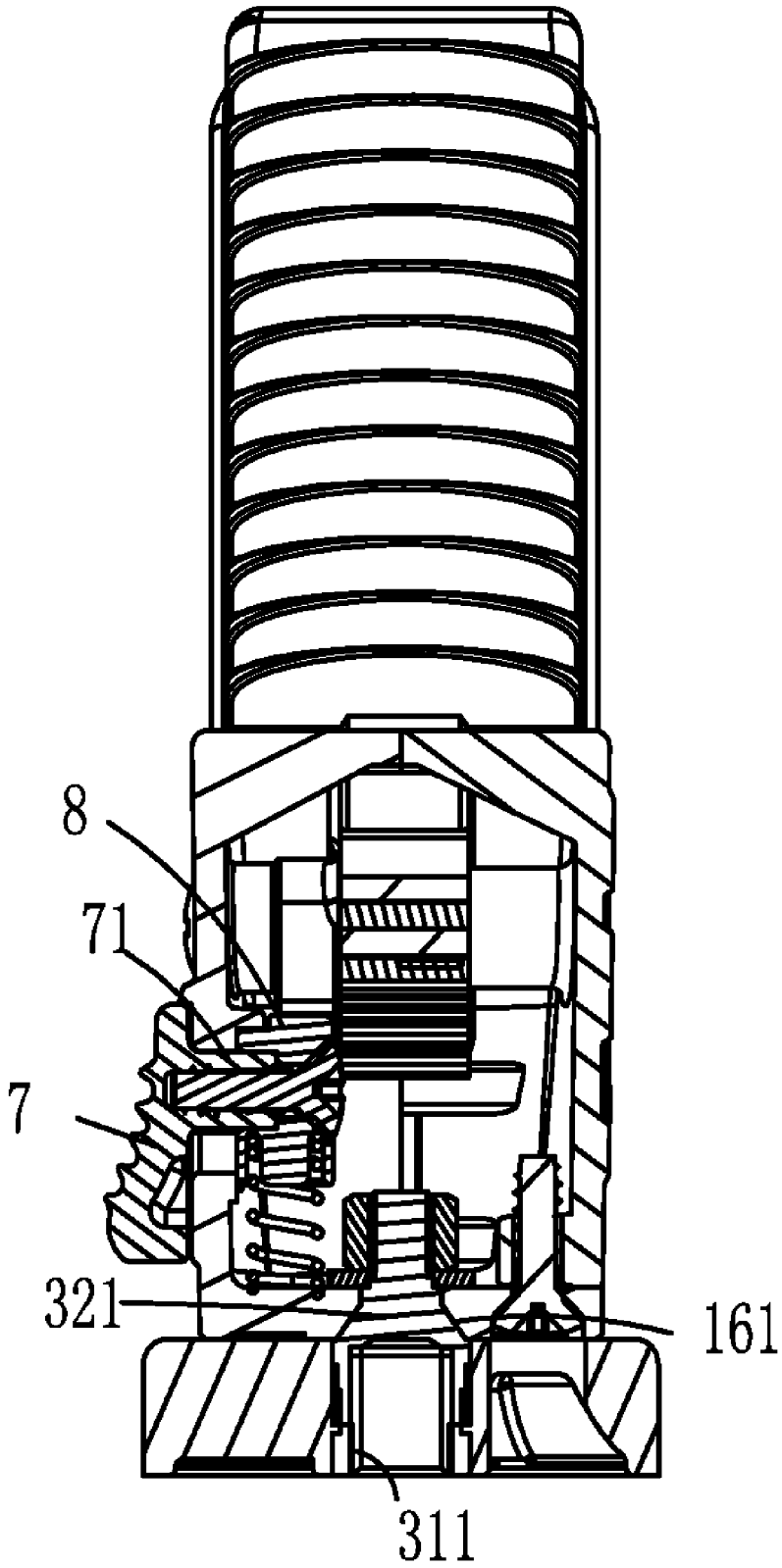
FIG. 10 is the A-A sectional view of FIG. 9.
Figure 11:
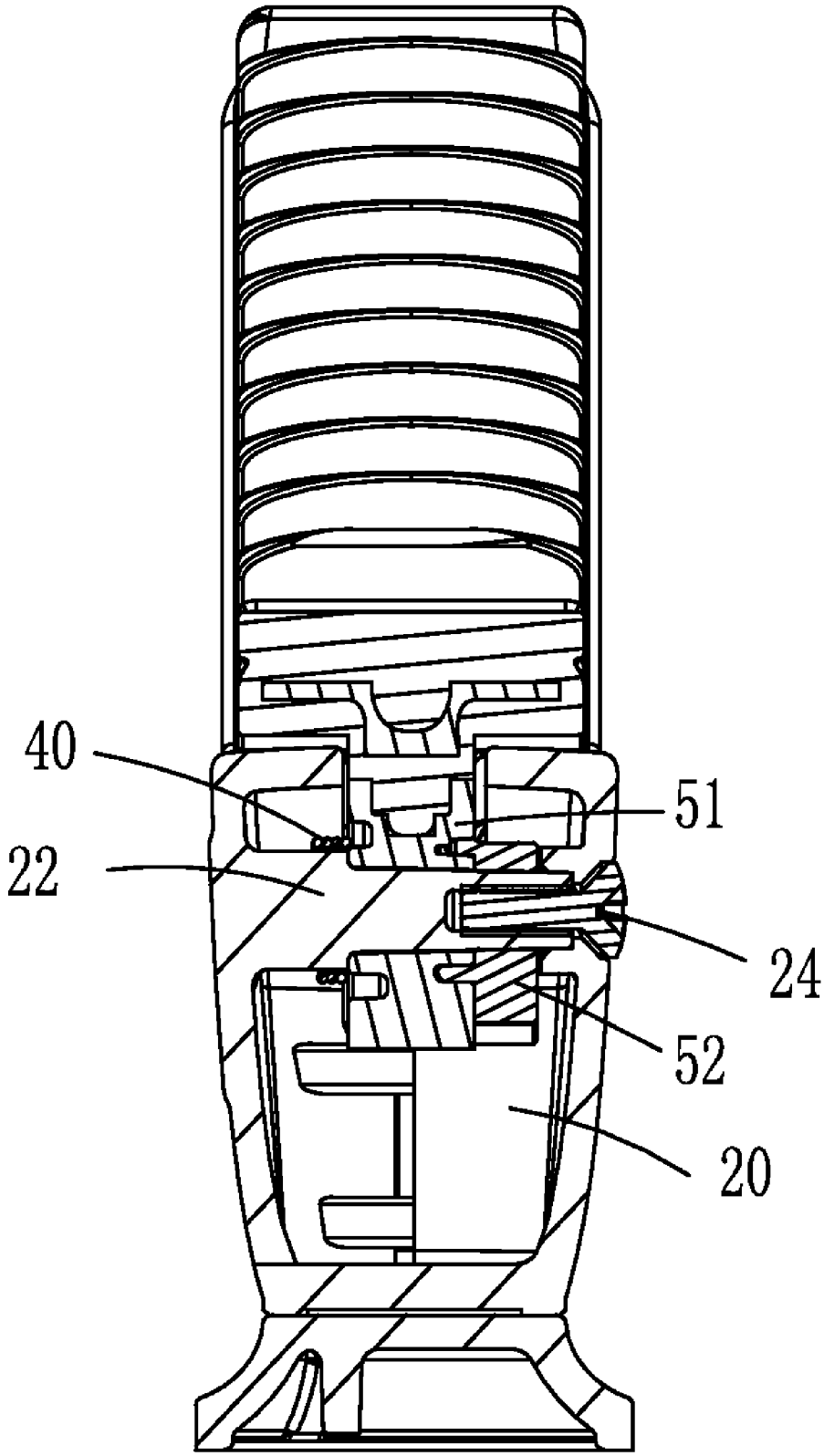
FIG. 11 is the C-C sectional view of FIG. 9.

As shown in FIGS. 2 and 10, the front cover 1 is also provided with a vertically arranged waist shaped hole 13 which is fitted with a blocking member. The blocking member comprises a button 7 arranged outside the cavity 20, having a strut 71 pass through the waist shaped hole 13, and a block 8 arranged inside the cavity 20 for receiving the strut 71 and fixed to the strut 71 by a screw. As shown in FIGS. 7 and 8 A bottom end 81 of the block 8 is attached to a compression spring 40 so that when the block 8 is driven by the button 7 to slide downwards, the spring 40 can resist such action and can restore the block 8 to its original position when the button 7 is released. A top end 84 of the block 8 is arranged for engaging the ratchet teeth of the ratchet wheels. The block 8 is also provided with two teeth 82, 83 arranged symmetrically beside its top end 84 to provide an additional engagement for the respective ratchet teeth on the left ratchet wheel 5 and the right ratchet wheel 6, each of the two teeth 82 and 83 and the top end 84 defines a seat 85 or 86 for accommodating a respective ratchet tooth of the left ratchet wheel and the right ratchet wheel during the engagement.

As shown in FIGS. 4, 5, 6 and 7, with the help of the compression spring 40, the block 8 is acting as a pawl in a ratchet mechanism for engagement with the ratchet wheels, i.e. when the two arms are driven together, the ratchet wheels are pivotally moved and the respect ratchet teeth thereon will compress the teeth 82, 83 arranged on the block 8 and force the block 8 to move downwards tooth by tooth; when the two arms 3, 4 are driven to a desired position the teeth 82, 83 on the block 8 is restored to their original positions by the compression spring 40 and engage to a respect one of the ratchet teeth on the respective ratchet wheels 5, 6. Otherwise, when the arms 3, 4 are to be driven apart from each other, the ratchet wheels 5, 6 are locked by the block 8 since a respective one of the ratchet tooth on the left and the right ratchet wheels are engaged in the respective seat 85 or 86 and block by the top end 84 of the block 8.

Figure 9:
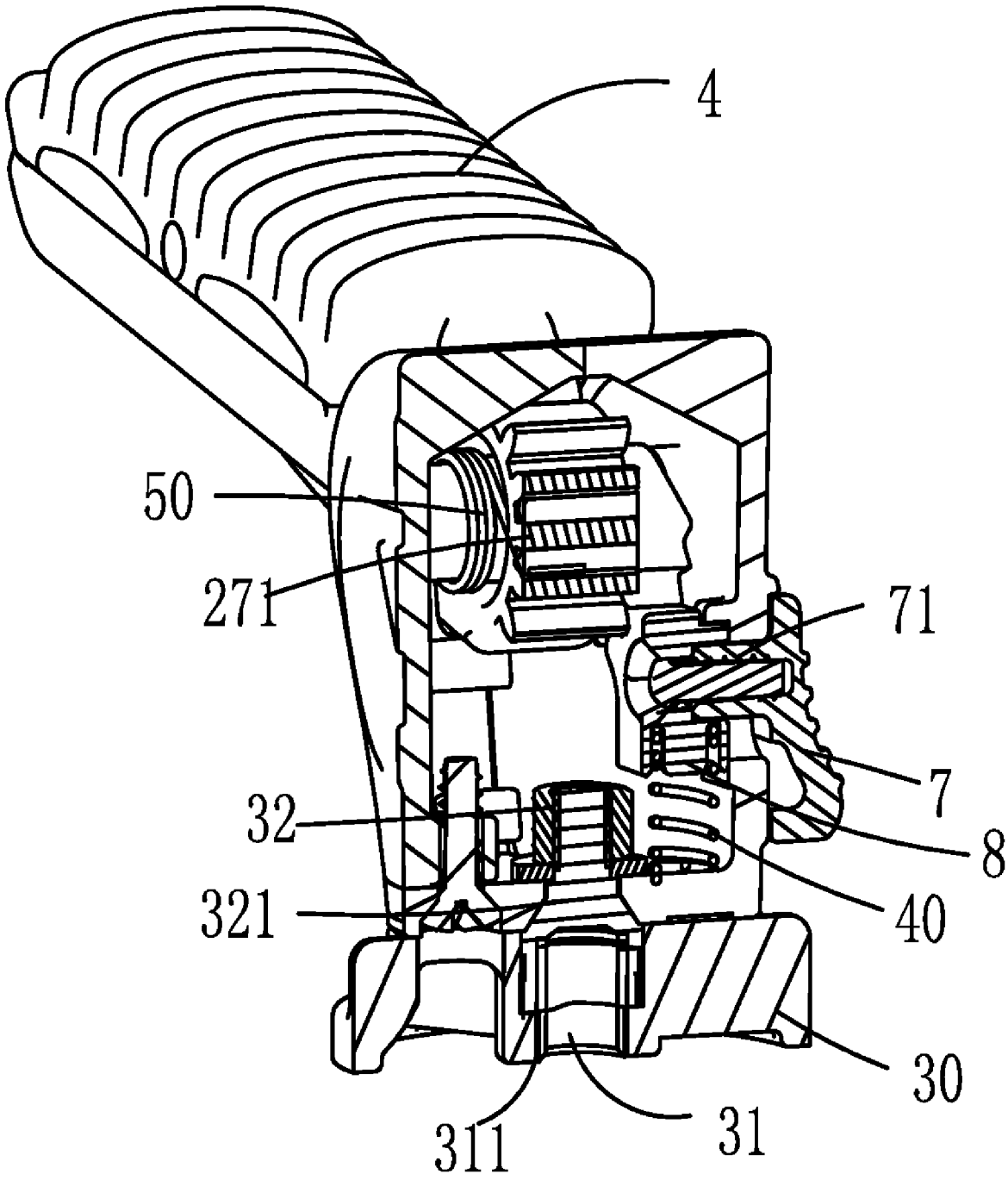
FIG. 9 is a sectional view of a head according to one embodiment of the invention.

The front cover 1 is also provided with a bottom 16 for mounting the body pivotally to a base 30. As shown in FIGS. 2, 9 and 10, the bottom 16 is provided with a central frustum hole 161, the base 30 is also provided with a central straight hole 31. As shown in FIG. 9, a bolt 32 having an unthreaded frustum section 321 is arranged to pass through both the central holes and fixed to an anti-backlash nut 33 by a washer 34 with the unthreaded frustum section 321 engage in the frustum hole 161 on the bottom 16 with a clearance, so that the body 10 is pivotally movable relative to the base 30. If the engagement is too tight, the anti-backlash nut 33 can be raised a bit to increase the clearance.

The lower part of the central straight hole 31 is also provided with a section of internal thread 311 for engagement with an external foot of the gun support apparatus.

In this invention, preferably, the straight teeth on the left and the right arms are designed with reference to the ratchet teeth on the left and the right ratchet wheel so that the arms can be positioned with included angle of 80 degrees, 120 degrees or 160 degrees. However, these opening positions are exemplary positions, a person skilled in the art can design the straight teeth and the ratchet teeth so as to lock the head in various opening positions.

The operation of the head 100 is described as follows:

When a smaller included angle between the two arms is desired, any one of the two arms can be revolved to fold the arms together, and with help of the ratchet wheels 5, 6 and the block 8, the arms will be revolved tooth by tooth and reach the desire position.

When a larger included angle between the two arms is desired, the button 7 is slide downwards to drive the block also moving downwards, whereby the ratchet teeth are detached from the seats of the block and the arms are unfolded by means of the torsion spring 50.

What is claimed is:

1. A Head for a gun support apparatus, comprising a body, a left arm assembly, a right arm assembly, and a blocking member, wherein the left arm assembly is pivotally coupled to the body, the right arm assembly is pivotally coupled to the body and is engaged to the left arm assembly so that they can be revolved simultaneously, the blocking member is engaged to both the left arm assembly and the right arm assembly to form a ratchet mechanism.

2. The Head for a gun support apparatus of claim 1, wherein each of the left and/or the right arm assembly comprises an arm and a ratchet wheel fixed to the arm.

3. The Head for a gun support apparatus of claim 2, wherein the arm of the left and the right arm assembly are provided with straight teeth by means of which the left and the right arms are engaged.

4. The Head for a gun support apparatus of claim 3, wherein the ratchet wheels of the left and the right arm assembly comprises a gear portion having at least partially thereon a plurality of ratchet teeth.

5. The Head for a gun support apparatus of claim 4, wherein the blocking member comprises a block assembly, which is engaged to the ratchet teeth of the left and right ratchet wheels and is fixed to a button.

6. The Head for a gun support apparatus of claim 5, wherein the block assembly comprising a block and a compression spring attached to a bottom end of the block.

7. The Head for a gun support apparatus of claim 6, wherein a button is fixed to the block through a waist shaped hole on the body, which detaches the block from the ratchet teeth by downward sliding.

8. The Head for a gun support apparatus of claim 7, wherein the block is firmly engaged with the ratchet teeth of the ratchet wheel when the arms are revolved to a predetermined position.

9. The Head for a gun support apparatus of claim 1, wherein the head further comprises a base on which the body can be pivotally mounted.

10. The Head for a gun support apparatus of claim 9, wherein the base is provided with a central straight hole, the body is provided with a central frustum hole, a bolt having an unthreaded frustum section is arranged to pass through both the central holes and fixed to an anti-backlash nut by a washer wherein the unthreaded frustum section engage in the frustum hole on the bottom with a clearance.

11. The Head for a gun support apparatus of claim 10, wherein the clearance can be adjusted by the anti-backlash nut.

12. The Head for a gun support apparatus of claim 11, wherein the central straight hole is provided with internal threads for engaging to a foot of a gun support apparatus.

13. The Head for a gun support apparatus of claim 1, wherein the arms can be revolved to positions having an included angle of 80 degrees, 120 degrees or 160 degrees.

* * * * *